United States Patent [19]

Manschot

[11] Patent Number: 4,471,540

[45] Date of Patent: Sep. 18, 1984

[54] APPARATUS FOR POSITIONING A DRAG NOZZLE CARRIED BY A SUCTION TUBE

[75] Inventor: Dirk Manschot, Krimpen, Netherlands

[73] Assignee: Boskalis Westminster Baggeren B.V., Netherlands

[21] Appl. No.: 458,664

[22] Filed: Jan. 17, 1983

[30] Foreign Application Priority Data

Jan. 18, 1982 [NL] Netherlands ..... 8200171

[51] Int. Cl.[3] ..... E02F 3/88

[52] U.S. Cl. ..... 37/58

[58] Field of Search ..... 37/58, 66, 72, DIG. 8

[56] References Cited

U.S. PATENT DOCUMENTS

| | | | |
|---|---|---|---|
| 208,894 | 10/1878 | Eads | 37/66 X |
| 1,106,038 | 8/1914 | Fruhling | 37/66 |
| 4,083,134 | 4/1978 | Oterdoom | 37/58 |
| 4,208,813 | 6/1980 | Latimer | 37/DIG. 8 |
| 4,249,324 | 2/1981 | Latimer | 37/58 |
| 4,255,882 | 3/1981 | Verboom | 37/58 X |

FOREIGN PATENT DOCUMENTS

| | | | |
|---|---|---|---|
| 9516 | 4/1980 | European Pat. Off. | 37/58 |
| 2096672 | 10/1982 | United Kingdom | 37/58 |

*Primary Examiner*—Clifford D. Crowder

*Attorney, Agent, or Firm*—Roylance, Abrams, Berdo & Goodman

[57] ABSTRACT

Apparatus for positioning a drag head or suction nozzle carried by a suction tube comprises a least one roller coupled with the nozzle. The roller is rotatable about a horizontal roller shaft and pivotable about a vertical axis in a controlled manner relatively to the nozzle. By means of the roller the nozzle can be forced to move in, or move back into, a desired path, which may deviate from a straight line.

6 Claims, 2 Drawing Figures

APPARATUS FOR POSITIONING A DRAG NOZZLE CARRIED BY A SUCTION TUBE

Figure 1:
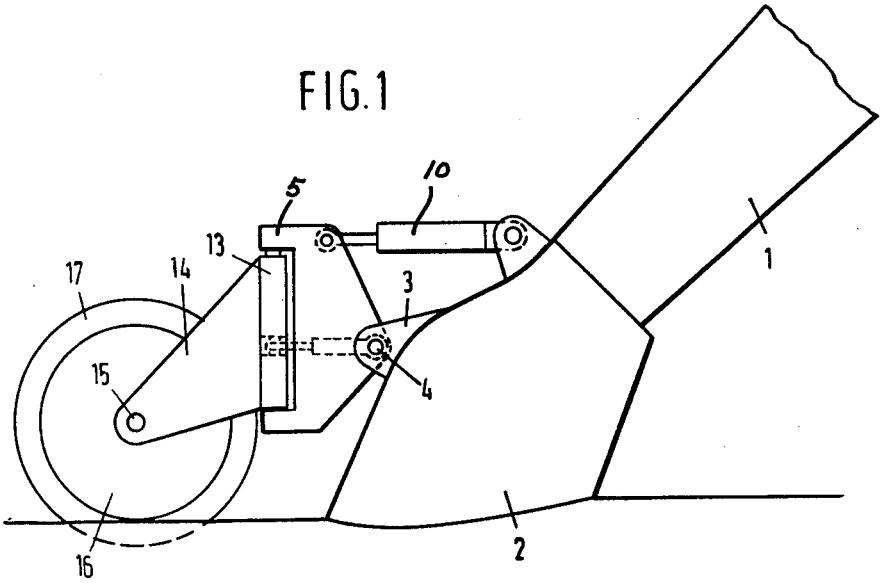

This invention relates to an apparatus for positioning a drag head or nozzle carried by a suction tube, with which the head can be steered over the bottom so that when it leaves a desired path it can be returned thereto and that the path to be followed may deviate from a straight line.

In a dredging process to be carried out with a sand-pump dredger with a drag nozzle, it is often the intention for the nozzle to excavate a uniform layer over a large area, or for the area in question to be levelled. A layer could be uniformly excavated by travelling in parallel paths, if it were not for the circumstance that these are disturbed owing to the position of the travelling dredger being imperfectly maintained, and also owing to bottom irregularities and flow effects which tend to move the nozzle out of its path.

Owing to these deviations from the ideal course, ridges are formed in the bottom during dredging. Once a ridge has been formed, this results in a progressive process, owing to the fact that the nozzle slides off the ridge and sucks away the base of the ridge, owing to which ridge formation is aggravated. To prevent this, during the dredging process, the dredger is moved according to a pattern in which new paths make an angle with preceding paths. In this way ridge formation can be prevented, it is true, but at the same time the resulting ground surface deviates substantially from the ideal surface as a result of the formation of numerous little ground hills and ridges, arising from the dredging pattern applied. As, furthermore, excavation should often be effected down to a certain minimum level under water, this also means that more ground must be removed than is strictly necessary, as the tops of the little hills and ridges partly determine the level reached.

Furthermore the path covered by the nozzle depends on the dredger's course. Conversely, this means that a considerable amount of helmsmanship is required to have the nozzle follow its desired path, and certainly so if this deviates from a straight line. In this connection it is observed that measuring systems are known to determine the position of the nozzle relative to the dredger, for example by means of a wire tensioned between nozzle and dredger, the length and direction of which indicate the position of the nozzle relative to the dredger rather accurately. By means of a second position-finding system, e.g. radar, the position of the dredger relative to a fixed on-shore point is determined, from which the position of the nozzle relative to that fixed point can be determined as well.

It is an object of the present invention to provide an apparatus with which the nozzle's position—to be measured—can be influenced by means other than course corrections of the dredger, while in particular care can be taken that the nozzle is not unintentionally displaced from its desired position, or in any case can be forced to move back into such position.

This is achieved, according to the invention, by providing at least one roller coupled with the drag nozzle, said roller being rotatable about a horizontal roller shaft, and being controllable to pivot about a vertical axis relatively to the nozzle.

Owing to these features the nozzle is steerable by having the roller shaft make an angle with the direction in which the nozzle is dragged over the bottom, referred to herein as the direction of travel, which owing to the contact between the roller and the bottom generates a force which has a component perpendicular to the direction of travel of the nozzle. By means of this force the nozzle can be forced to move out of the path it is following, or forced to move back into its desired path which it had left. The first possibility makes it possible to have this nozzle travel in a path deviating from a straight line without this being brought about solely by changes in the course followed by the dredger. The second possibility makes for preventing the formation of ridges when the dredger travels in parallel paths, which means both a simpler navigation pattern and avoiding residual minor ground hills and ridges, and thus having a considerable cost-saving effect. As the second possibility also permits the nozzle to be forced to maintain its course on a slope, without the risk of sliding off it, it is also possible to excavate existing ridges and bulges in an efficient manner, which considerably increases the field of application of the positioning system according to the invention. In addition, during normal operation the roller stabilizes the course of the nozzle by forcing the same back into its—straight—path when it tends to leave it.

In the above, the invention has been described with reference to traditional dredging operations. It should be noted, however, that the invention can also be applied to other areas, such as for deep-sea mining, in which ore is mined by means of a suction nozzle. The use of a positioning system according to the invention makes it possible for the ore to be mined with a nozzle moved in parallel paths. This possibility brings the mining efficiency of a dragged nozzle to the same level as that of a self-propelled and steered head.

To optimize contact between bottom and roller, it is preferable, in accordance with a further embodiment of the invention, that the roller is provided as its surface with protruding reaction surfaces, with a further preference being given to reaction surfaces consisting of at least one annular disk extending perpendicular to the roller surface over and above, for example, reaction surfaces arranged helically around the roller circumference. When the roller pivots relatively to the nozzle, the more intensive contact between bottom and roller in that embodiment favours the generation of the reaction force in the desired direction. In addition, the amount of the force component transverse to the direction of travel can be further influenced by varying the pivot angle. That force component can be further influenced when, in accordance with a further embodiment of the present invention, the roller is arranged to be driven. Such an embodiment has the additional advantage that, by driving the roller so that it slips relatively to the bottom, the interspaces between the reaction surfaces can be prevented from becoming clogged or filled with appendant soil. This advantage is in particular eloquent when operating in cohesive soils.

In order to prevent the roller or the nozzle from becoming disengaged from the soil as the assembly is moving over an elevation in the bottom extending transversely to the direction of travel, it is preferable, according to a further embodiment of the present invention, that the roller is pivotable about a horizontal axis relatively to the nozzle. If, in that arrangement, the roller is in addition pivotable about the horizontal axis in a controlled manner, the force with which the roller can be pressed on the bottom, and hence the steering force to be generated, can be additionally influenced.

This also provides for the possibility of adaptations to different kinds of soil, which can also be achieved, if desired by way of supplementary control, by making the roller hollow and fitting it with means for opening and closing the same, so that its weight can be varied in a simple manner.

Figure 2:
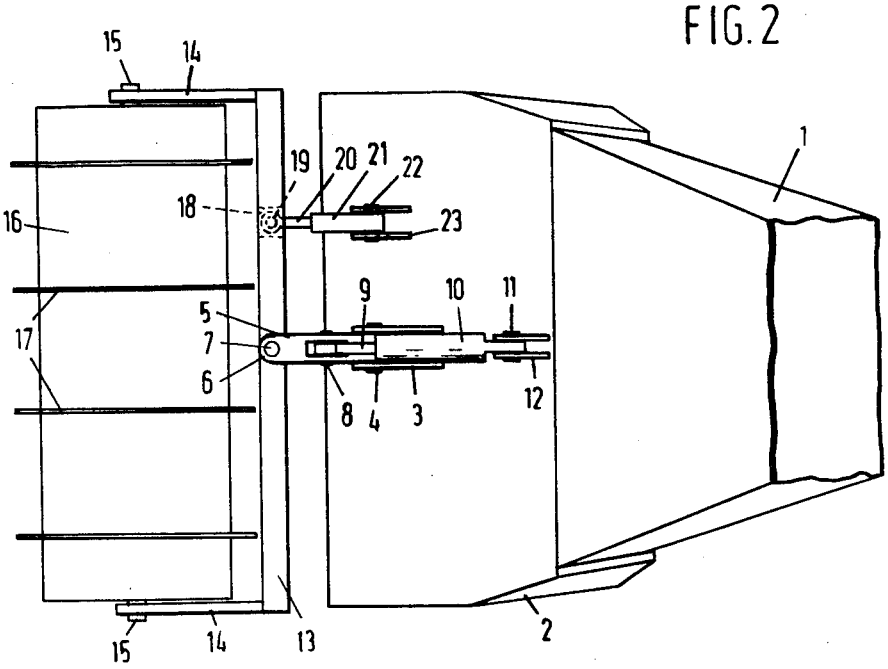

One embodiment of the positioning apparatus according to the invention will now be described, by way of example, with reference to the accompanying drawings, in which FIG. 1 shows a side-elevational view of the positioning apparatus according to the invention coupled to a drag nozzle; and FIG. 2 is a plan view of the apparatus shown in FIG. 1.

The drawings diagrammatically show a drag nozzle 2 attached to the end of a suction tube 1.

Fixedly connected to a nozzle 2, for example, by welding, is a pair of lugs 3, mounting a shaft 4 extending horizontally and transversely to the direction of travel of nozzle 2, on which shaft a pair of plates 5 are mounted in such a manner that these plates 5 are pivotable about the axis of shaft 4 relatively to nozzle 2. The two plates are interconnected, inter alia, by a pair of eyes 6 disposed in spaced vertical alignment with each other and mounting a pair of trunnions 7. Plates 5 further mount a shaft 8, which is connected to the free end of a piston rod 9 of a cylinder 10. The bottom part of cylinder 10 is connected to a shaft 11 mounted in a pair of lugs 12 fixedly connected to nozzle 2.

Trunnions 7 are secured, in alignment with each other, to the respective upper and lower edges of a rectangular plate 13. Secured to the side edges of plate 13 are a pair of ears 14, which extend perpendicular to the surface of plate 13, and mount a shaft 15. A roller 16, secured to shaft 15, is provided with four fins 17 in the form of of annular disks, which are rigidly connected to roller 16 and extend substantially at right angles to the surface thereof.

Formed in plate 13 is a recess 18, in which a shaft 19 extends in the vertical direction. The free end of a piston rod 20 of a cylinder 21 is mounted for rotation around shaft 19. The bottom of cylinder 21 is connected to a shaft 22, located in alignment with shaft 4, and mounted in a pair of ears 23 fixedly mounted in nozzle 2. Cylinder 21 is mounted for—at least some—pivoting movement about a vertical shaft connected to shaft 22.

The operation of the positioning apparatus described above is as follows. When following a straight path over an even bottom, nozzle 2 will not be forced out of its path. The positioning apparatus can then in principle remain inoperative, for example, by allowing roller 16 to idle in the position shown in FIGS. 1 and 2.

If the nozzle 2 must be displaced in a lateral direction, for example, as a result of a change in the path to be followed, or in order to force nozzle 2 back into its desired path, if the latter has been left as a result, for example, of sliding off a ground ridge, this is initiated by activating cylinder 21. Depending on the direction of the desired lateral displacement of nozzle 2, piston rod 20 is protracted or retracted, which results in a pivoting movement of plate 13 and hence shaft 15 or roller 16, about trunnions 7. As a result of this movement of roller 16, it encloses an angle with the direction of travel of nozzle 2, which owing to the contact between bottom and roller, intensified by fins 17, results in a force component transverse to that direction, as a result of which nozzle 2 is displaced in the transverse direction into its desired position.

In order to further influence this transverse displacement, and also to keep the interspaces between fins 17 free from any appendant soil, roller 16 may be arranged to be positively driven in a manner not shown. When in such an arrangement roller 16 is driven at such an angular velocity that its peripheral speed deviates from the dragging velocity, roller 16 will slip over the bottom, as a result of which any soil clinging to it will be removed, and further adherence will be prevented owing to the formation of a liquid film on the roller.

The transverse displacement can be further influenced with cylinder 10 with which the vertical force with which roller 16 is pressed on the bottom is adjustable for adaptation to different soils. This can further be achieved, if desired by way of supplementation, by making roller 16 hollow and forming a closable opening, for example, in a side thereof, through which ballast material can be introduced into, and removed from, roller 16.

Cylinder 10 can further be designed to function as a pneumatic spring, so as to overcome local differences in level between nozzle 2 and roller 16 without there being a risk of nozzle 2 or roller 16 being lifted off the bottom.

It is observed that, in its position shown in FIG. 1, roller 16 has a preventative effect against unintentional straying of nozzle 2 off its (straight) course, as this will be counteracted by roller 16.

It will be understood that many changes and variants are possible without departing from the scope of the invention. In addition to the above-described supplements to the embodiment shown in the drawings, it is further possible for the fins to be helically arranged around the roller. By driving the roller in a suitable manner in that arrangement, the direction of the transverse displacement, and the amount of the transverse displacement force can be adjusted even without a displacement in the direction of travel being required. Naturally, any other number of fins 17 than the four shown can be mounted on roller 16, and also the pivoting construction with cylinder 21 can be duplicated, for example in a symmetrical arrangement relative to trunnions 7. Furthermore, the double pivot construction about shafts 4 and 7 can be constructionally implemented in many other ways which will be readily apparent to those skilled in the art.

In the above, reference is made to a suction tube. In view of the nature of the positioning apparatus, it will be clear that this suction tube may be either an essentially rigid conduit or pipe or a flexible hose without any directional, stiffness of its own.

I claim:

1. An apparatus, comprising:

a drag nozzle coupled to a suction tube;

at least one roller rotatable about a horizontal shaft, and pivotally coupled to said drag nozzle for movement about a vertical axis relative to said drag nozzle; and means for controlling pivotal movement between said drag nozzle and said roller about said vertical axis.

2. An apparatus according to claim 1, wherein said roller comprises a roller surface with projecting reaction surfaces.

3. An apparatus according to claim 2, wherein said reaction surfaces comprise at least one annular disk extending perpendicular to said roller surface.

4. An apparatus according to claim 1 wherein said roller is pivotable about a horizontal axis relative to said drag nozzle.

5. An apparatus according to claim 4, wherein said roller is pivotable about said horizontal axis in a controlled manner.

6. An apparatus according to claim 1, wherein said roller is hollow .

* * * * *